US005239148A

United States Patent [19]

Reed

[11] Patent Number: 5,239,148

[45] Date of Patent: Aug. 24, 1993

[54] LANE DISCRIMINATING TRAFFIC COUNTING DEVICE

[75] Inventor: John W. Reed, Baltimore, Md.

[73] Assignee: Progressive Engineering Technologies Corp., Baltimore, Md.

[21] Appl. No.: 700,428

[22] Filed: May 15, 1991

[51] Int. Cl.[5] ..... H01H 3/16

[52] U.S. Cl. ..... 200/86 A; 73/146; 340/666; 340/933

[58] Field of Search ..... 200/86 R, 86 A; 307/119; 73/146; 235/99 A; 340/626, 666, 933, 940

[56] References Cited

U.S. PATENT DOCUMENTS

| | | | |
|---|---|---|---|
| Re. 18,507 | 6/1932 | Morris . | |
| Re. 28,365 | 3/1975 | Braue | 200/86 |
| 1,889,602 | 11/1932 | Hill . | |
| 1,928,472 | 9/1933 | Wilcox | 200/86 |
| 1,950,490 | 3/1934 | Geer et al. | 200/86 |
| 2,067,336 | 1/1937 | Paver | 235/92 |
| 2,077,924 | 4/1937 | Geer et al. | 177/329 |
| 2,132,685 | 10/1938 | Hampton et al. | 200/86 |
| 2,134,800 | 11/1938 | Putnam | 200/86 |
| 2,138,549 | 11/1938 | La Bell et al. | 200/86 |
| 2,161,896 | 6/1939 | Cutler | 200/86 |
| 2,163,960 | 6/1939 | Paver | 200/86 |
| 2,181,728 | 11/1939 | Greentree | 235/92 |
| 2,213,409 | 9/1940 | Quilliam | 177/337 |
| 2,330,872 | 10/1943 | Diebold | 234/12.5 |
| 2,437,969 | 3/1948 | Paul | 200/86 |
| 2,493,157 | 1/1950 | Merralls et al. | 200/86 |
| 2,790,872 | 4/1957 | Helsper | 200/86 |
| 2,796,488 | 6/1957 | Cooper | 200/86 |
| 2,823,279 | 2/1958 | Schulenburg | 200/86 |
| 2,885,508 | 5/1959 | Wilcox | 200/86 |
| 2,909,628 | 10/1959 | Cooper | 200/86 |
| 2,939,925 | 6/1960 | Cole | 200/61.44 |
| 2,959,647 | 11/1960 | Hohmann | 200/86 |
| 3,243,540 | 3/1966 | Miller | 200/86 |
| 3,393,284 | 7/1968 | Goble | 200/86 |
| 3,398,397 | 8/1968 | O'Connell | 340/52 |
| 3,485,977 | 12/1969 | Goble | 200/86 |
| 3,544,746 | 12/1970 | Wolf | 200/86 |
| 3,654,407 | 4/1972 | Kepner et al. | 200/86 |
| 3,694,600 | 9/1972 | Koenig | 200/86 |
| 3,732,384 | 5/1973 | Fischel | 200/86 |
| 3,748,443 | 7/1973 | Kroll et al. | 235/92 |
| 3,818,162 | 6/1974 | Monroe et al. | 200/86 |
| 3,830,991 | 8/1974 | Durocher | 200/86 |
| 4,839,480 | 6/1989 | Bickley | 200/86 A |
| 5,047,602 | 9/1991 | Lipka | 200/86 R |
| 5,096,329 | 3/1992 | Haile | 404/12 |

*Primary Examiner*—Gerald P. Tolin
*Attorney, Agent, or Firm*—Foley & Lardner

[57] ABSTRACT

A traffic counting cord has a plurality of sections designed to be identical in physical characteristics, set-up procedures, durability and performance as a road tube. Each section has a portion with conductive upper and lower members and a portion with non-conductive upper and lower members. The upper and lower members are separated by resilient, non-conductive material. Embedded within the members are a plurality of wires insulated with nylon or other material and at least one non-insulated wire which is in contact with the conductive member. A count occurs when traffic impacting the cord causes the upper and lower members of a section to make contact. Individual counts for each lane can be obtained by cross-wiring the sections, so that the uninsulated conductors of each section are routed to a counter through insulated conductors or wires of the other sections. Any even or odd number of lanes, typically four, six, or eight lanes can be accomodated, although there is no theoretical limit. An alternative embodiment replaces the wires with resilient conductive material channeled through the cord to improve reliability.

22 Claims, 15 Drawing Sheets

34

30
24
26
28
CONDUCTIVE MATERIAL
"B" SPLICE
NON-CONDUCTIVE MATERIAL
CONDUCTIVE MATERIAL
NON-CONDUCTIVE MATERIAL
19
DOWNWARD COMPRESSION FORCE

"B"-SPLICE 32
200
NON-CONDUCTIVE MATERIAL
18

"A"-SPLICE

"B"-SPLICE

LANE DISCRIMINATING TRAFFIC COUNTING DEVICE

FIELD OF THE INVENTION

The invention is a method and apparatus for counting vehicular traffic, in general. In particular, the invention provides a method and portable, yet durable, apparatus for discriminating the counting of vehicular traffic in multiple lanes.

RELATED ART

The Federal Highway Administration and other government agencies often require the submission of reports concerning truck travel at specific locations on roadways before authorizing funding for the repair and improvement of such roadways. Such reports are typically submitted in a format known as the Federal Highway Administration Axle Classification Scheme. A number of classifying machines are currently in manufacture. Typically, they require two axle detector inputs positioned a known distance apart. The machine measures the time between axle actuations, calculates the speeds at which the axles are traveling, counts the number of axles traveling at the same rate of speed, and then, depending upon results, records the vehicle type in a predetermined classification bin. Such studies are typically undertaken over a continuous 24 hour period and are broken down into one hour increments. Portable axle detector devices manufactured and available today vary greatly in cost, durability, limitations of operation and set up procedure difficulty.

It is common industry practice to employ a pneumatic road tube which is laid across the roadway in such studies. Rubber pneumatic road tubes create an air pulse when impacted by a tire. The air pulse is sensed by a counting machine and treated as an axle actuation. However, when the road tube is placed across multiple lanes, it is not possible for the counting machine to discriminate which lane the air pulse originates from. In order to accomplish such lane discrimination, air tubes are typically tied off so that only tire impacts by traffic in a specific lane create an air pulse to be counted. In order to obtain a count for each of the multiple lanes, it is necessary to use separate air pulse counting machines for each lane. Costs resulting from the duplication of equipment and the lengthy set up time required often result. In addition, vehicles traveling at low speeds across the road tubes sometimes fail to create an air pulse strong enough to be sensed. As a result, human classifiers are often also needed to avoid inaccurate traffic counts.

Electrical contact systems or treadle switches have also been used in multiple lane vehicular traffic counting applications. U.S. Pat. No. 2,067,336 to Paver discloses a deformable strip 10 with flat bottom 15 and an inclined approach to the top 16. Pressure exerted by traffic deforms the strip by pressing the rubber and spacer locks at one or more points so as to bring strips 11 and 12 into electrical contact at one or more places. Each of the contact strips 10 is connected to a separate counter or recorder using connector strips 18 which carry a plurality of flexible wires 23, in order to obtain a separate count for each traffic lane. One problem is that the spaced strips 11 and 12 of resilient metal, such as phosphorbronze, are held in separated relation by resilient or compressible spaced members in the form of short blocks 13 of sponge rubber. Even though both the rubber and the spaced strips are resilient, the inability of the strips to move within the surrounding sponge rubber causes them to undergo significant stresses which reduces traffic cord life and causes early failures.

U.S. Pat. No. 2,823,279 to Schulenburg discloses a strip that is adapted to be buried in the road and has a switch construction in which upper and lower switch contacts 26 and 28 are mounted to contact strips 25 and 27 so that contact 26 is moved into engagement with contact 28 when the wheel of a vehicle depresses top wall 20 of tube 17. The contact strips 25 and 27 are supported by resilient fingers 23 and 24 which maintain the separation of contacts 26 and 28 when vehicle pressure is not present. The lower resilient fingers 24 act as a strain release to prevent undue pressure from being applied to the contact strips 25 and 27 and to the contacts 26 and 28. The extruded tube housing 17 has hollow interior 21 into which these contacts and contact strips are assembled. Schulenburg '279 is limited because of its fixed construction and inability to be transported. In addition, Schulenburg '279 fails to disclose counting traffic in multiple lanes.

U.S. Pat. No. 2,909,628 to Cooper discloses a treadle switch with a common contact strip 16 affixed to an upper portion of an envelope 12 forming the top wall of a hollow longitudinal pocket 14 in rubber envelope 12. Single contact strip 18 is positioned under the common contact strip 16. Segments 22, 24, 26 and 28 are spaced one from the other in aligned relation and are molded with conductors 32, 34, 36 and 38 embedded therein. The conductors are connected to respective contact segments. The angular shape of the contact segments is an important design factor. In addition, Cooper relies on the inherent resiliency of envelope 12 to flex contact strip 16 to sequentially make contact with each of the contact segments.

U.S. Pat. No. 2,796,488 also to Cooper disclose a method for attaching metallic contact strips to a rubber envelope during the molding of the envelope to form a treadle adapted to be embedded in a roadway.

Despite the development of numerous electrical treadle switches, pneumatic counting devices, which have higher reliability and are more easily transportable, gradually replaced such electrical treadle switches in traffic counting applications. This is because the stresses on such treadle switches result in lower life expectancies and are less portable than pneumatic systems. However, as previously discussed, pneumatic systems have significant disadvantages in their ability to count multiple lanes of traffic simultaneously.

SUMMARY AND OBJECTS OF THE INVENTION

In view of the above limitations of the related art, it is an object of the invention to provide a portable and durable multiple lane traffic counting system.

It is a further object of the invention to provide a traffic counting system which does not require the use of an air pulse, but instead operates based on switch closures.

It is a still further object of the invention to provide a traffic counting system which is compatible with existing traffic counting hardware.

It is another object of the invention to provide a traffic counting system which is portable and can be installed without additional training of personnel familiar with pneumatic road tube traffic counting systems.

It is a further object of the invention to provide a traffic counting system which is durable and accommodates lane based traffic classification studies.

It is still another object of the invention to provide a highly accurate traffic counting system which detects vehicles traveling at both low and high speeds across the road tubes.

It is still another object of the invention to provide a traffic counting system which need not be manned on a regular basis.

The above objects of the invention, and others, are accomplished by an electrical traffic counting system which avoids the disadvantages of conventional treadle switches. A traffic counting cord has a plurality of sections which can be spliced together. Each section has a conductive portion and a non-conductive portion, each with upper and lower members. The upper and lower members of the conductive portion are formed of a conductive resilient material such as a conductive rubber or conductive synthetic material, while the upper and lower members of the non-conductive portion are formed of rubber or synthetic material with non-conductive characteristics. A plurality of wires, typically 6 or 8, is embedded in one of the members of each section, e.g., the lower member. An additional wire is embedded in the other conductive and non-conductive members of each section. Within each section, all the wires are insulated except for one of the lower wires which is not insulated in order to make contact with the conductive resilient material of that section. In one embodiment, in each section, a different one of the wires in the lower section is exposed. In one preferred embodiment, the exterior wires are exposed and the sections are spliced together in a crossover manner, so that traffic impacting each section is separately counted. The wire in the upper conductive portion is also exposed, so that under pressure from traffic in a lane corresponding to a section, contact between the exposed upper and lower wires in the corresponding section is made. When wires of a plurality of sections are spliced together, a multiple traffic lane detector cord is formed. Each of the wires in the lower section members are routed to counters, while the wires in the upper section member are routed to a reference voltage, such as ground. Since traffic impacting each section will result in a connection between the exposed upper wire and lower wire in the lane corresponding to the section, lanes are individually counted.

In another preferred embodiment, the wires or metallic conductors are replaced by conductive and non-conductive material, such as resilient conductive and non-conductive material in order to improve durability. Such materials can be placed in dedicated channels within the upper and lower portions of the cord.

BRIEF DESCRIPTION OF THE DRAWINGS

The invention herein will be described with particularity with reference to the drawings in which.

DETAILED DESCRIPTION OF THE PREFERRED EMBODIMENTS

A traffic counting cord according to the invention has a plurality of sections with each section having conductive members, on the top and bottom of the section, respectively. A resilient non-conductor separates the upper and lower members. The conductive members are typically of resilient conductive material such as conductive rubber or other conductive synthetic rubber like material, including thermal plastic elastomer (TPE). Further reference throughout this application to conductive rubber is meant to include materials mentioned in the preceding sentence. The same or similar non-conductive materials can be used for the non-conductive members discussed herein. The sections may also have a portion of non-conductive upper and lower members adjacent to the conductive upper and lower members so that when sections are assembled together to form a cord, the conductive and non-conductive portions are alternately arranged. This results in a cord with upper and lower non-conductive members separating upper and lower conductive members in a longitudinal direction. A plurality of nylon insulated conductors or wires is embedded within the upper and lower, conductive and non-conductive members of each section. The insulation is made of nylon to facilitate movement of the wire within the members. Within the conductive portion of each section of the cord, at least one conductor is at partially exposed to make contact with the conductive rubber or other conductive synthetic material (TPE) of the upper and lower portions of the section. The sections are spliced together with corresponding wires connected to each other. In one embodiment portions of different wires in each section are exposed to contact the conductive portion of that section. Contact is then made between different pairs of upper and lower wires when the different sections are compressed together. As a result, traffic can be counted individually in a plurality of lanes by assembling a cable in which each section corresponds to a lane of traffic to be counted.

In one preferred embodiment, all the sections are formed with the outermost conductors or wires in the one of the upper and lower members being uninsulated for contact with the conductive members. A cross splice is formed between sections so that traffic impacting the cord is counted separately for each section. For example, in a three section cord, the uninsulated outer wire in the first section is connected to a first insulated wire running through the remaining two cord sections to a first counter, the outer uninsulated wire in the section is connected to an insulated wire running through the third section to a second counter, and the outer uninsulated wire in the third section is connected to a third counter. As a result, cord impact from traffic over a section which results in effectively closing a switch in the section, causes a count to be recorded only in the corresponding counter.

Figure 1:
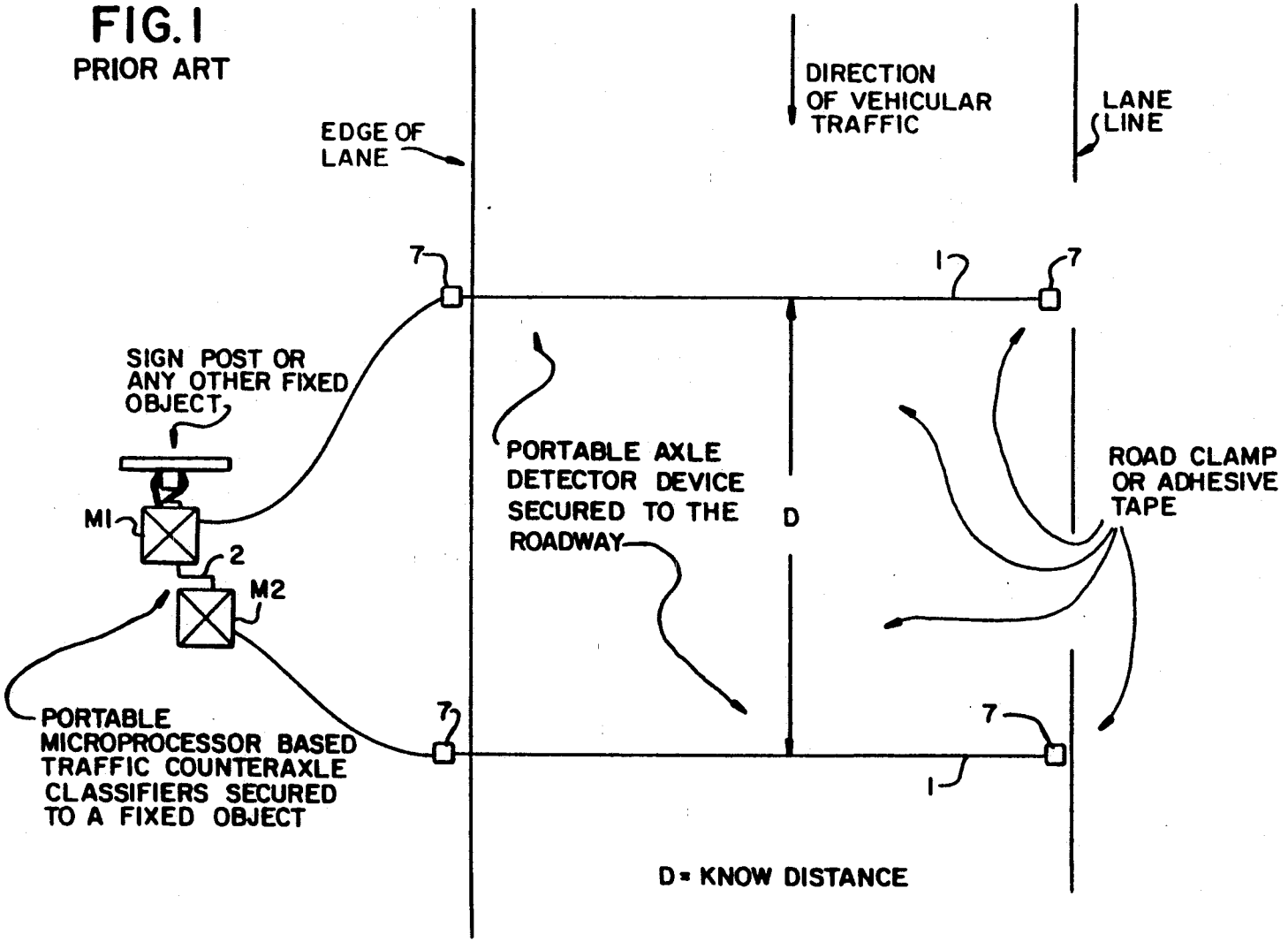
FIG. 1 PRIOR ART
FIG. 1 shows a typical prior art configuration for a Federal Highway Administration axle classification study at a remote field site.

FIG. 1 shows a typical set-up configuration for a portable Federal Highway Administration (FHWA) axle classification study at a remote field site. Reports of such studies are submitted in the FHWA Axle Classification Scheme format. The classifier could be any one of a number of machines manufactured today which all require two axle detector inputs positioned a known distance apart. As previously discussed, the machines measure the time between axle actuations, calculates the speed at which the axles are traveling, counts the number of axles travelling at the same rate of speed, and then, depending upon results, records the vehicle type in a pre-determined classification "bin". The machine's report is automatically generated and may be edited either at a personal computer or mainframe level. Studies are typically done over a continuous 24-hour period (or longer, as required) and are broken down into one-hour increments. Gap studies are done to determine how many seconds of gap are between vehicles to allow left-hand turns onto roadways at "T" intersections. Presently two machines (M1, M2) are needed and an electrical (2) connection between the two is necessary. The invention herein provides a more durable and less expensive alternative. One machine (equipment now in use), one technician, two switches according to the present invention, existing set-up procedures and hardware are all that would be necessary to perform a study of this type ff a product of this type was to be produced. The portable axle detector devices manufactured and available today vary greatly in cost, durability, limitations of operation and set-up procedures.

Figure 2:
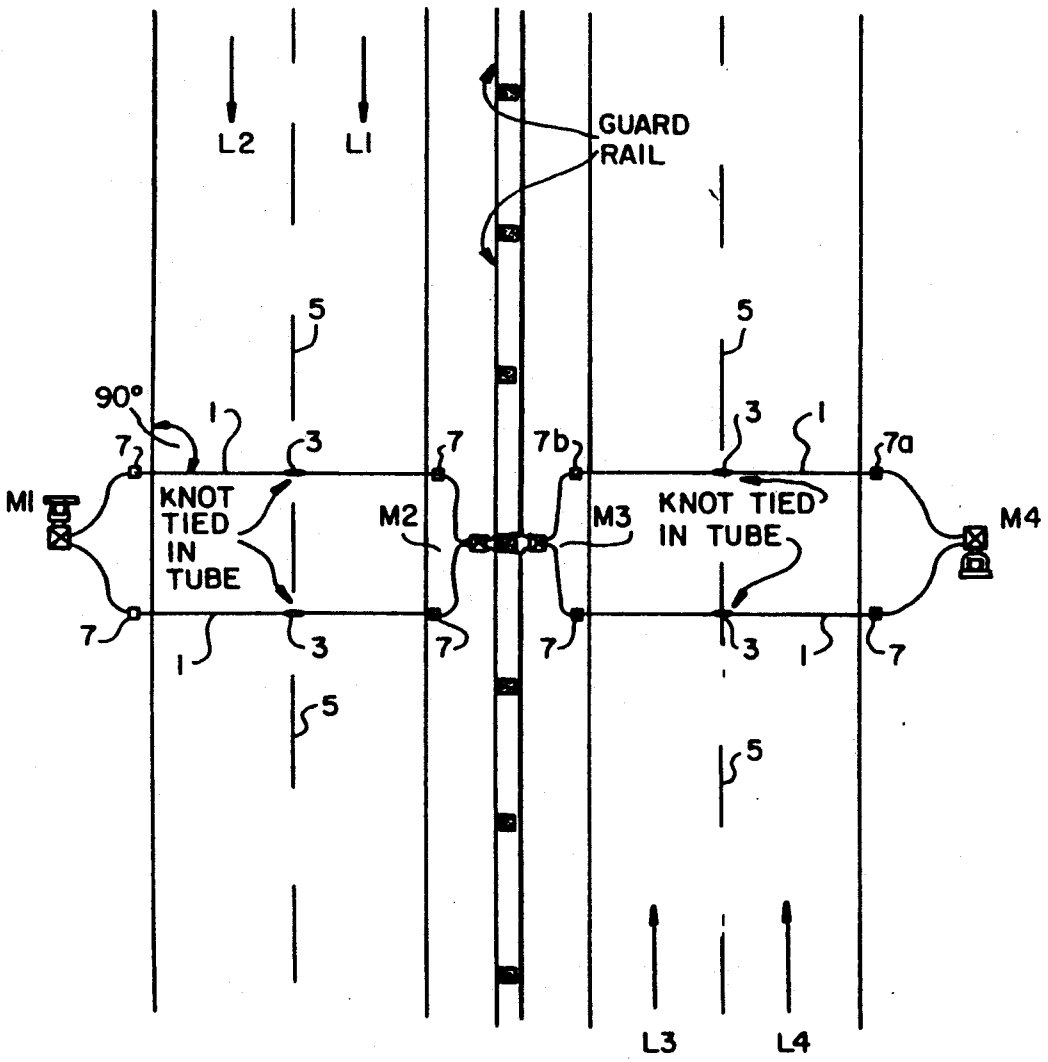
FIG. 2 PRIOR ART
FIG. 2 shows a prior art four lane roadway counting configuration with classifiers set up in a common configuration used to accommodate these conditions.

FIG. 2 shows a four-lane roadway with classifiers set-up in a common configuration used to accommodate these conditions. Rubber pneumatic road tube 1, when run over by a tire, creates an air pulse which is sensed by a machine (M1–M4) as an axle actuation. The knots 3 shown tied in the tubes 1 and placed over the lane lines 5 are used to separate the pulses created by vehicles travelling in the four individual lanes. For example, a vehicle travelling in lane 1 would be recorded by machine Ml. Rubber pneumatic road tube is the most widely and commonly used portable axle detection device because of its low cost (20 cents to 50 cents per foot depending on supplier, quantity, configuration and tube specifications), durability and ease of set-up. Rubber compounds used today can withstand a significant mechanical stress. One pneumatic tube may be used over and over at different study locations. It is not uncommon for a tube to operate for a number of months before it fails. The tube can be run over in any configuration or position it might be lying in the roadway and not sustain any structural damage whatsoever. This is extremely advantageous during the set-up procedures. Pneumatic road tube set-up procedures usually require only one man outfitted in a reflective safety vest and helmet. The steps in such procedures include:

a. Securing a hose clamp, e.g. *7a*, into the roadway by using special case-hardened nails designed specifically for installation into asphalt concrete (AC).
b. Placing one end of the tube 1 into the secured clamp 7 allowing enough tube 1 to stretch across the roadway on one side and enough tube on the other end to reach the machine nearest the clamp 7.
c. Stretching the tube 1 across the travelled roadway and aligning it in such a way that vehicles cross over it at a perpendicular angle.
d. Securing a second hose clamp, e.g. *7b*, to the roadway in that position which will keep the tube 1 perpendicular to the vehicle crossing over it.
e. Placing the other end of the tube 1 into this second clamp *7b*.
f. Adjusting the position of the knot 5 in the tube so it sits on top of the lane line 5 by sliding the tube through the clamps until the correct position is attained.
g. Stretching the rubber pneumatic road tube enough to remove all slack and bounce that will be caused by vehicles passing over it. Care must be taken in this step. It is critical that the knot remain on top of the lane line to differentiate between lanes, but it is equally critical that the tube be stretched enough to eliminate slack and bounce or the results could be less than accurate.

Figure 6:
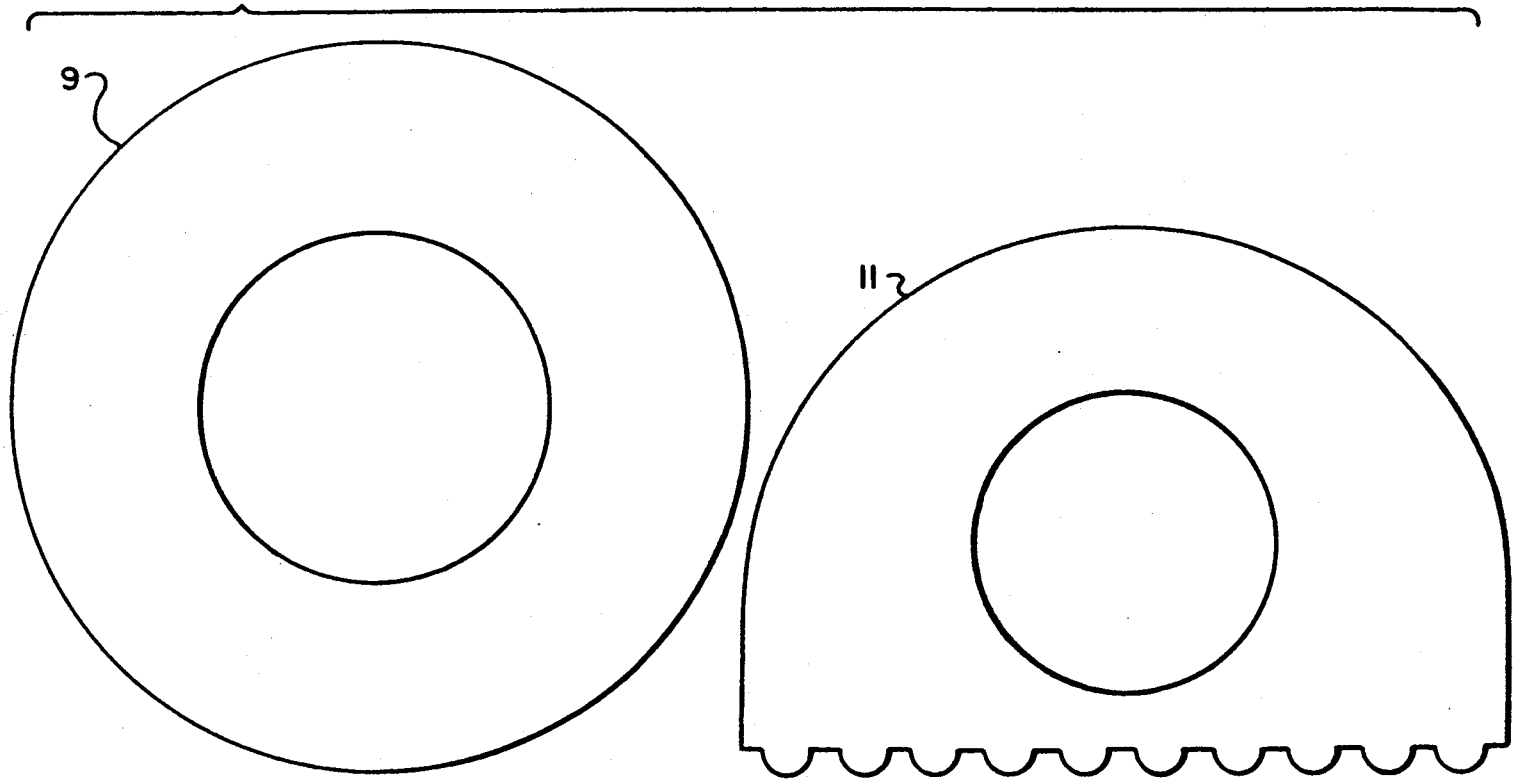
FIG. 6 is a cross sectional view of round and half round traffic counting tubes.

As shown in FIG. 6 there are two basic configurations of rubber pneumatic road tube: round tube 9 and half round tube 11, round tube 9 being the less expensive of the two. Half round road tube 11 does not bounce like the round tube when installed on roadways with high speed, multi-lane, high volume vehicular traffic. Round tube has a tendency to roll in the direction of vehicle travel after it has been run over. Large trucks travelling at high rates of speed create a vacuum on the underside of the body of the vehicle. Round hose, if not installed correctly, is sucked up into this vacuum. Half round road tube virtually eliminates both the problem of rolling and being sucked up into the bottom of trucks. Though a bit more expensive, half round road tube performs more effectively than round tube under these conditions.

Figures 3A, 3B:
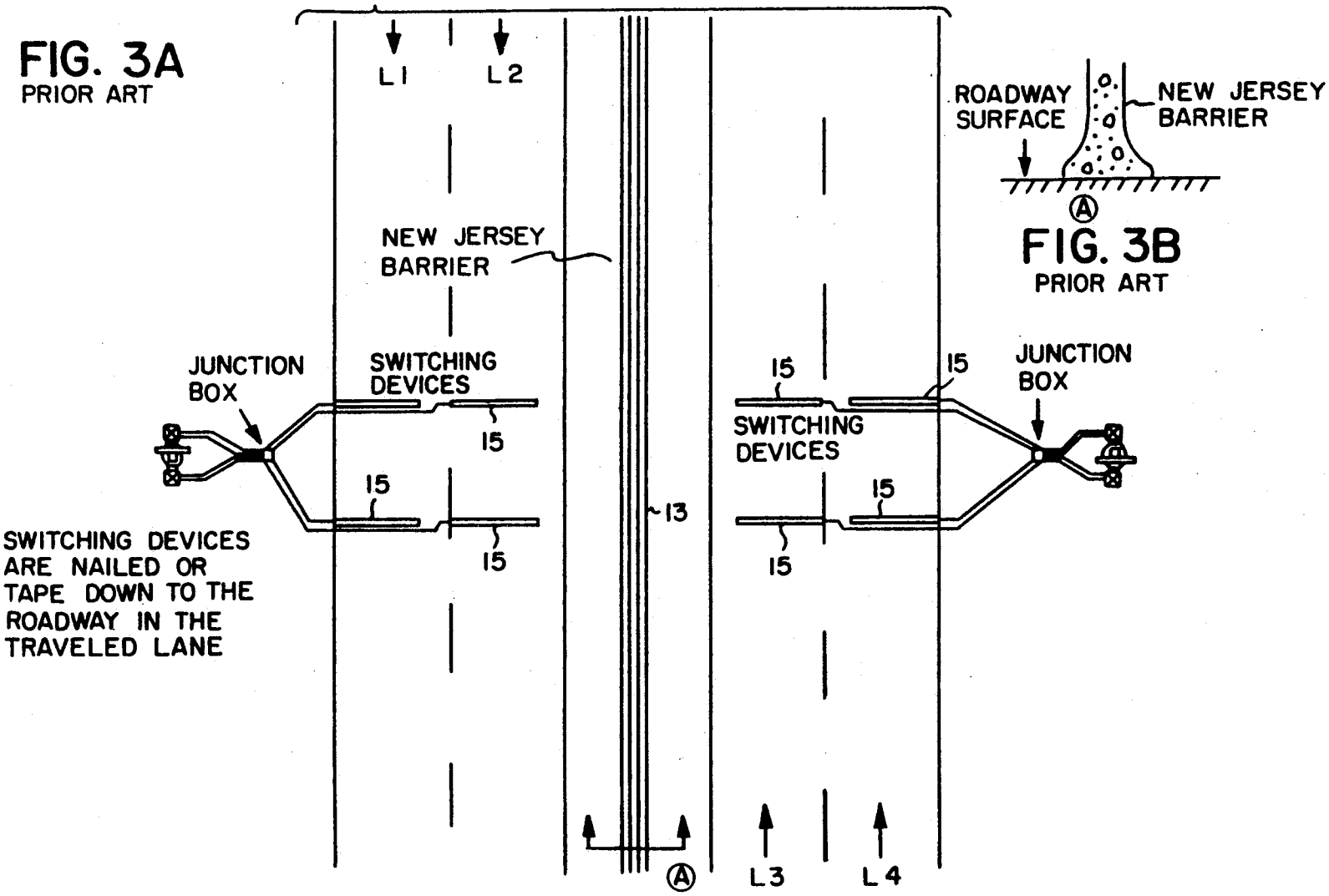
FIG. 3B PRIOR ART
FIG. 3A PRIOR ART
FIG. 3 is another prior art configuration which shows the limitations of operations for pneumatic road tubes when doing axle classification studies.

There are limitations of operation for pneumatic road tube when doing axle classification studies. FIG. 3 shows one case. As a result of New Jersey Barrier 13, there is no guard rail in the median for securing detector machines Rigid and flexible switches 15 are available on the market today to accommodate this type of situation; however, these switches are expensive and set-up procedures are far more complicated, dangerous and expensive. At least two men are required to set the machines. In addition, a special vehicle equipped with flashing arrow indicators is required. Traffic control becomes necessary to ensure the safety of the men installing these switches. Humans are commonly used in these situations to "hand" classify vehicles at field site studies where machine classifiers and pneumatic road tube cannot be used. Unfortunately the accuracy of human collected data tends to degrade after a period of time. In addition, such data must be edited and put into clean, final report format. A trade-off or compromise must be reached when faced with the dilemma of expensive inaccurate human classifiers or expensive, dangerous, accurate machine classifiers in these situations. Monies are budgeted annually specifically to pay wages to these classifiers.

Figure 7A:
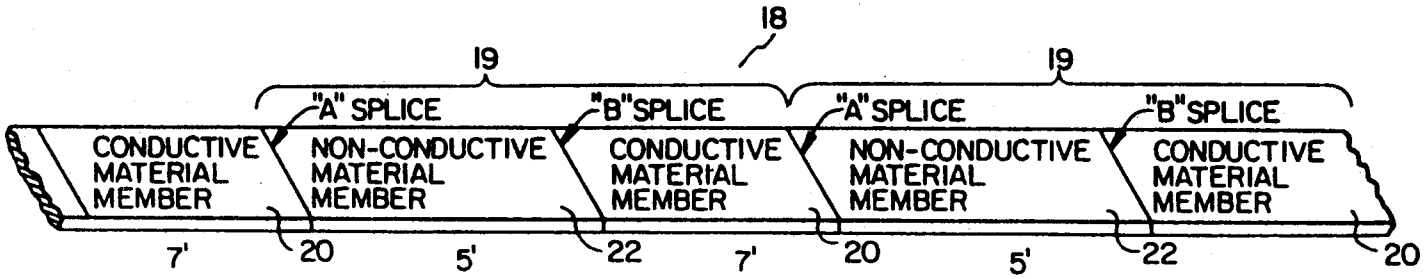
FIG. 7*a* shows interconnected sections of a traffic cord of the present invention.
Figure 7B:
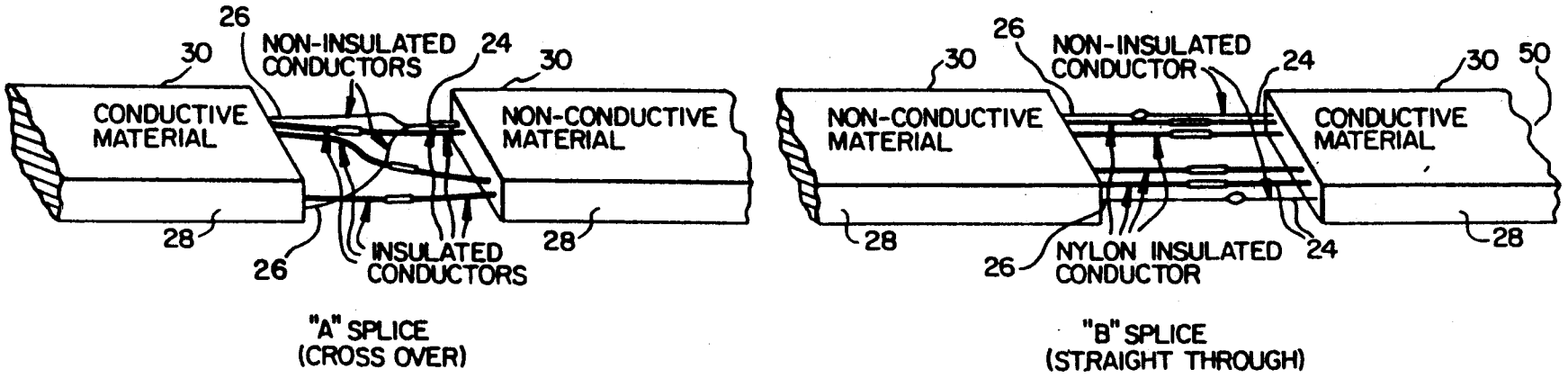
FIG. 7*b* shows splicing arrangements within and between cord sections.

FIG. 7*a* shows a bottom wire assembly 18 for a traffic cord 50 according to the invention. FIG. 9*a* illustrates a cross section of the bottom member. Each section 19 has a portion of conductive material 20 and non-conductive material 22. One such conductive material is Santoprene 101-64 and one such non-conductive material is Santoprene 199-87, which are available commercially. However, other conductive and non-conductive materials may be used. Each section is shown to be approximately twelve feet in length with seven feet being formed of the conductive material 20 and 5 feet being formed of the non-conductive material 22. It should be noted that these dimensions are given for purposes of illustration and not by way of limitation, as those or ordinary skill will recognize the dimensions can be varied to accommodate different traffic situations. Within each section is a plurality of conductors 24 insulated with nylon or other insulating material which are embedded in the conductive and non-conductive material. Also embedded in the non-conductive and conductive material 22, 20 are non-insulated conductors 26. Preferably, these are located as the outermost conductors closest to the front and rear surfaces 28, 30 of the conductive and non-conductive materials. FIG. 7*b* illustrates the splicing of the insulated conductors 24 and the non-insulated conductors 26 at the intersections between the non-conductive material and the conductive material within a section (B splice) and at the intersection between sections (A splice). The B splice is used within the section to connect corresponding insulated and non-insulated conductors together. Thus, the non-insulated outermost conductors of the non-conductive material are connected to the corresponding non-insulated conductors or wires which pass through the conductive material Similarly, the second nylon or other insulated conductor passing through the non-conductive material 22 is connected to the second nylon or other insulated conductor passing through conductive material 20. This is repeated for the third, fourth . . . nth conductors.

Figure 9B:
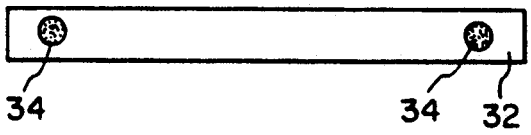
FIG. 9*a* and 9*b* are cross sectional views of lower and upper members, respectively.
Figure 9A:
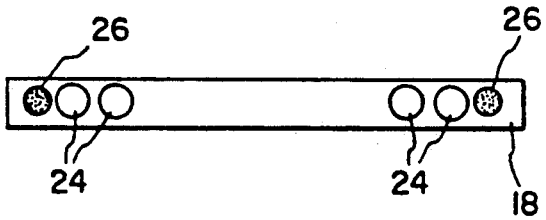
Figure 10:
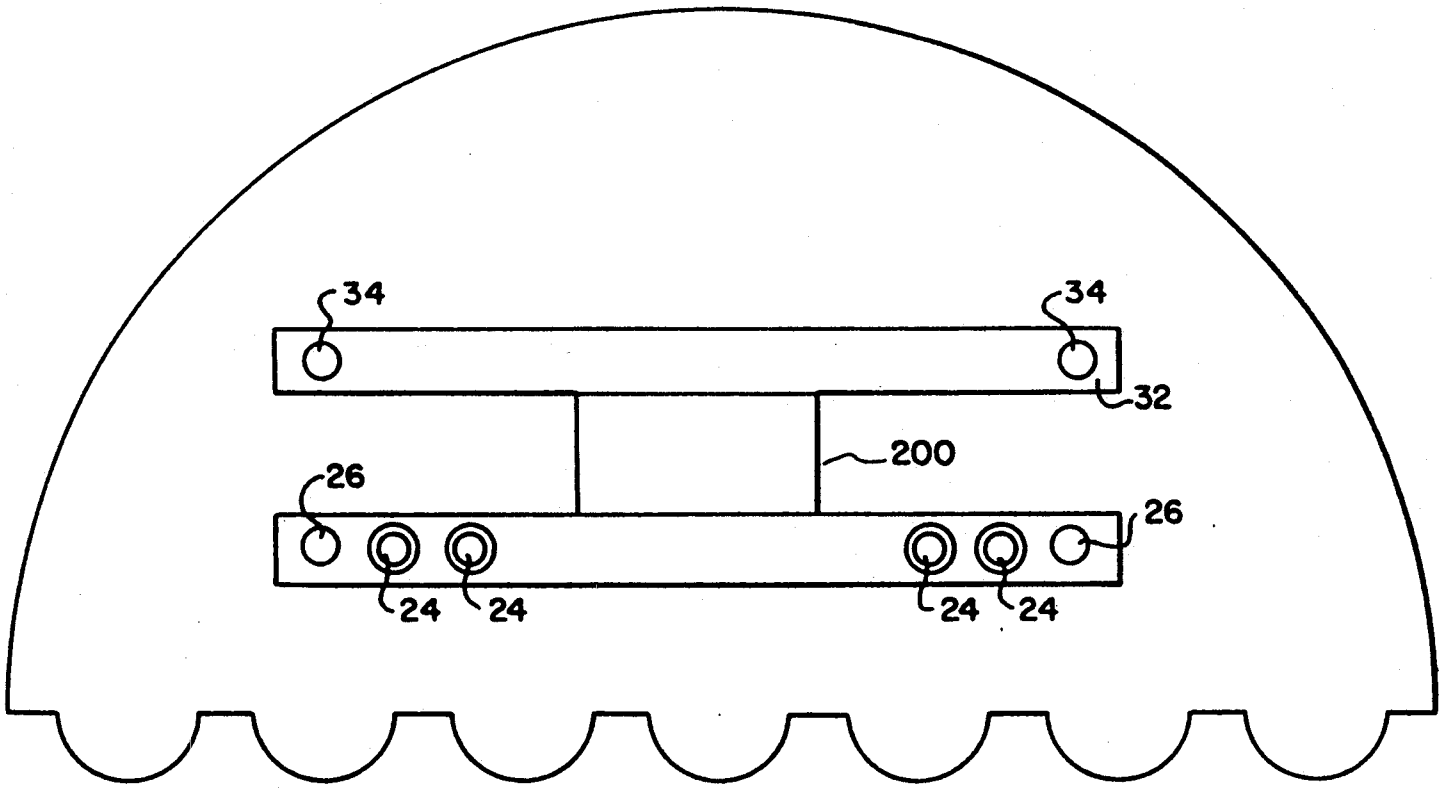
FIG. 10 is a cross sectional view of the wire assembly.

In order to count traffic, a second wire assembly 32 is formed, as shown in FIG. 9*b*. Top wire assembly 32 is formed of conductive and non-conductive members in sections corresponding to bottom wire assembly 18. In contrast to bottom wire assembly 18, top wire assembly 32 contains only two non-insulated conductors 34 which are preferably located to correspond generally to the position of non-insulated conductors 26 in bottom wire assembly 18. Interconnections between all non-conductive and conductive members of the top wire assembly are made as straight-through B splice connections, as previously discussed. It should be noted that when assembled, top and bottom wire assemblies 18 and 32 are separated by a resilient material 200 which allows the top and bottom wires 32 and 18 to make contact only when they are compressed together.

In order to count traffic, a section 19 having a bottom wire 18 and a top wire 32 separated by such a resilient member 200 is placed across a roadway. Each time the cord section is struck by passing traffic, the conductive members 20 of the top wire 32 and bottom wire 18 are compressed together. This has the effect of a switch closure. The non-insulated conductors 26 and the bottom wire assembly 18 is routed to a counter. The non-insulated conductors 34 in top wire assembly 32 are routed to a reference voltage, such as ground. Impact of traffic causes the conductive members to make contact and establish a circuit path between wires 34 and 26, so that the counter attached to wires 26 can be tripped.

The above arrangement provides for counting traffic in a single lane or for counting total traffic in all lanes simultaneously. Multiple lanes of traffic can be counted separately by altering which of the conductors is non-insulated in the bottom layer in each section. The sections are then wired together using a straight-through B splice. Each of the wires at the end of the cord is then connected to a separate counter so that individual counts for the individual sections would be recorded. While such an arrangement facilitates ease of connection, it has the disadvantage that each section must have a different non-insulated conductor, thus complicating the manufacturing process.

A preferred embodiment allows the use of the same lower member in each section with the non-insulated conductors 26 being located at the outermost portions nearest the front and rear faces 28 and 30 of the section 18. This is accomplished using the A splice wiring shown in FIGS. 7*b* and 7*c*. As FIG. 7*b* illustrates, the non-insulated conductors 26 are cross wired to different insulated conductors as they pass through the non-conductive material of the next section. As a result, traffic impact in the first section causes a count to be recorded as a result of the effective switch closure in that section The connection of the non-insulated conductors to an insulated conductor in the next section prevents traffic in the next section from affecting the count obtained in the adjacent lane. This is more clearly illustrated in FIG. 7*c*.

Figure 7C:
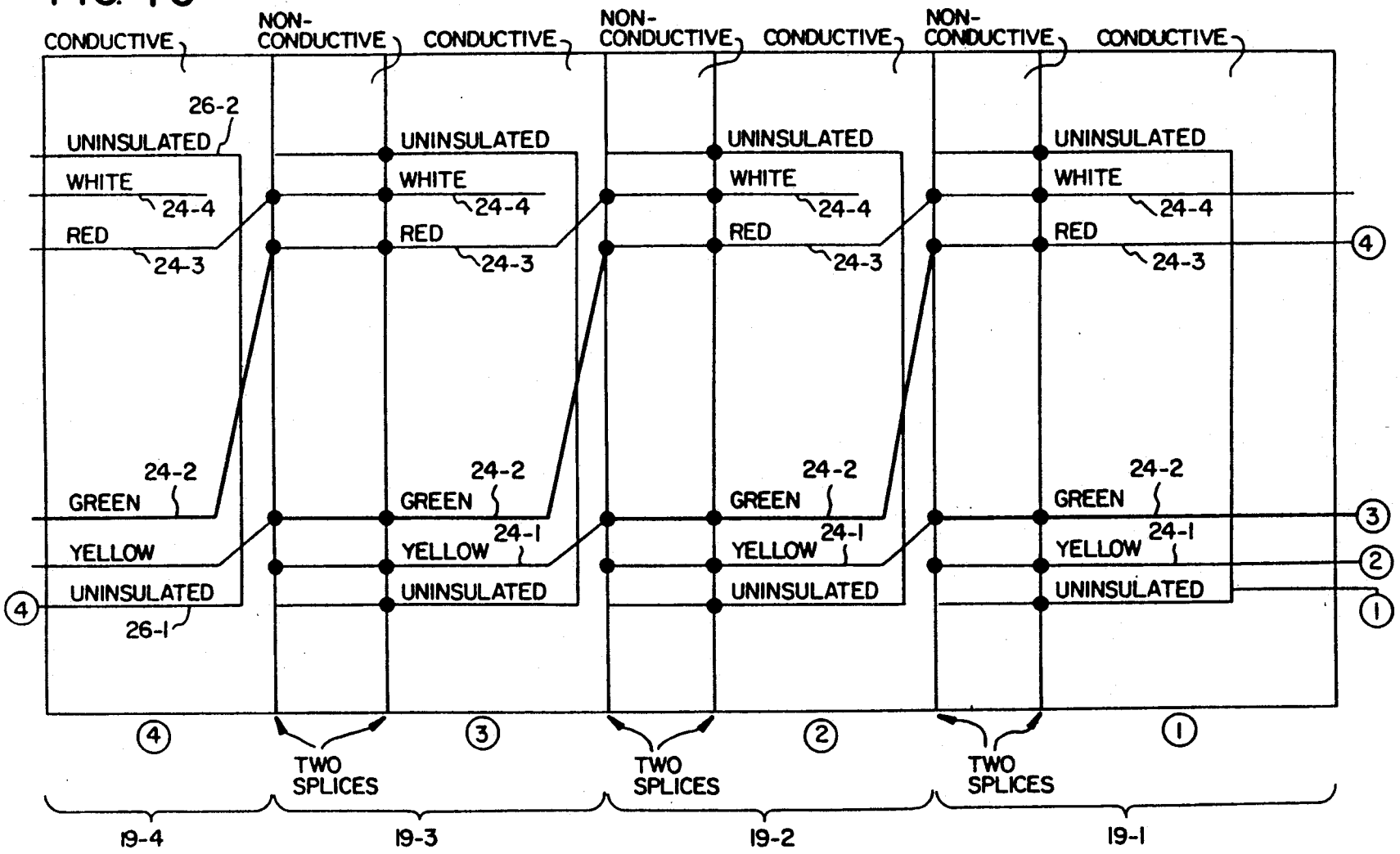
FIG. 7*c* shows electrical connections of splices between cord sections.

FIG. 7*c* shows a cross over configuration for a 4 lane bottom wire assembly. Since traffic in four separate lanes in being counted, four sections, 19-1 . . . 19-4, and three A splices A-1, A-2, A-3, are required. Four counters C1, C2, . . . C4, are used, with each counter being connected to one of the wires protruding from the end of the cord assembly. The simplest case is lane 1. The non-insulated conductors 26-1, 26-2 in section 19-1 are connected together and routed directly to counter C1. For lane 2, the non-insulated conductors 26-1, 26-2 in the corresponding second section 19-2 are connected together and are routed to one of the insulated conductors 24, e.g., the first insulated conductor 24-1 in section 19-1. The other end of conductor 24-1 in section 1, is then connected to counter C2 at the end of the cord after passing through the section corresponding to lane 1. In lane 3, outer connectors 26-1 and 26-2 are routed to a corresponding insulated conductor 24-1 in section 2, which is then routed through sections via a different insulated conductor 24-2 to counter C3. A similar approach is taken for lanes 4. In lane 4, the uninsulated conductor 26-1 is connected to insulated wire 24-1 in section 3, insulated wire 24-2 in section 2, and 24-3 in section 1. Insulated wire 24-3 is then connected to counter C4. As a result of these interconnections at the A splices, only traffic in lane causes counter C1 to be incremented. Similarly, only traffic in lane 2 causes counter C2 to be incremented. The same is true for lanes 3, and 4. Thus, even though each of the sections is constructed in the same way with the non-insulated conductors being located in the bottom wire assembly at the outermost portions closest to the front and rear faces 28 and 30, each lane is counted separately and individually.

FIG. 7c further illustrates that all the A splice wire interconnections can be made consistent for ease of assembly. FIG. 7c also illustrates that the insulated wires in the sections can be color coded and that all the B splices within the sections are simply straight through connections of the wires between the conductive and non-conductive members of each section. Table 1 below summarizes the connections both at the counter end and at the A splices for the four lane counter using the directional sense shown in FIG. 7c. It should be noted that the method and apparatus can be expanded to incorporate any desired number of wires for any number of lanes. In the preferred embodiment of FIG. 7c, the uninsulated outside wires, called drain wires, are connected together within the section, with an uninsulated single wire being brought to the end of the section for splicing purposes. However, both wires could be brought out and spliced together at the A splice area.

| | | | A-Splice | |
|---|---|---|---|---|
| Lane | End Connection to Counter | Section Wire | Left Connection | Right Connection |
| 1 | C1 | 26-1 Uninsulated | open | 24-1, yellow |
| 2 | C2 | 24-1 yellow | 26-1, Uninsulated | 24-2, green |
| 3 | C3 | 24-2 green | 24-1, yellow | 24-3, red |
| 4 | C4 open | 24-3 red 24-4 white | 24-2, green 24-3, red | 24-4, white open |

Figure 8A:
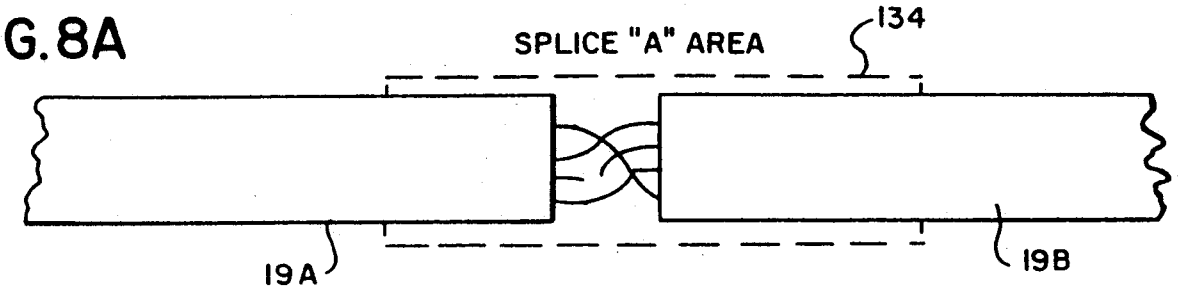
FIGS. 8*a*, 8*b* and 8*c* illustrate alternative section mating configurations at the splice area.
Figure 8B:
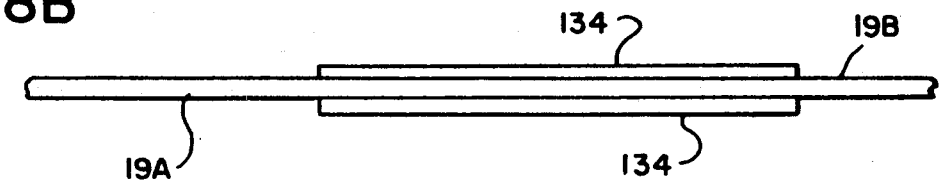
Figure 8C:
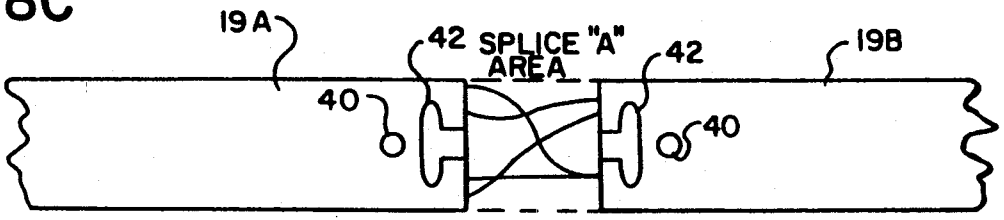

FIG. 8a, 8b, and 8c illustrate detail of the splice A area between, for example, two sections 19a and 19b. In one embodiment shown in FIGS. 8a and 8b, the splice is formed by overlapping a slightly wider member 134 across the intersection of the two sections 19a and 19b. As shown in FIG. 8a, if the members 19a and 19b of the sections have a width of 0.70 inches, the overlapping member 134 would have a width of 0.775 inches. FIG. 8b shows a side elevational view indicating that the thickness of the members 19a and 19b is 0.075 inches while the overall thickness of the splice area including a pair of overlapping members would be 0.135 inches. This is each of the overlapping splice members 134 a thickness of 0.030 inches. It should be noted that the above dimensions are by way of illustration and are not limitative in the invention, as different dimensions could be used for any of the numbers. FIG. 8c illustrates an alternative detail of a splice A area configuration. The top view shown in FIG. 8c illustrates that the section 19a and 19b are formed with hole 40 and notch 42 to facilitate gripping. The overlapping numbers would have corresponding protrusions which would be snapped into the holes.

An alternative configuration of a traffic counting cord which performs the functions discussed above is shown in FIGS. 11-13. This configuration improves reliability and durability by making use of conductive and non-conductive materials in place of the wires previously discussed. Such materials can be resilient conductive rubber or synthetic rubber like materials including thermal plastic elastomer (TPE), as previously discussed. This provides additional longitudinal stretch, more closely resembling the characteristics of the rest of the road tube. Incorporation of such materials further simplifies assembly, requiring fewer assembly steps and lowering cost, since A and B splices are not required.

Figure 11:
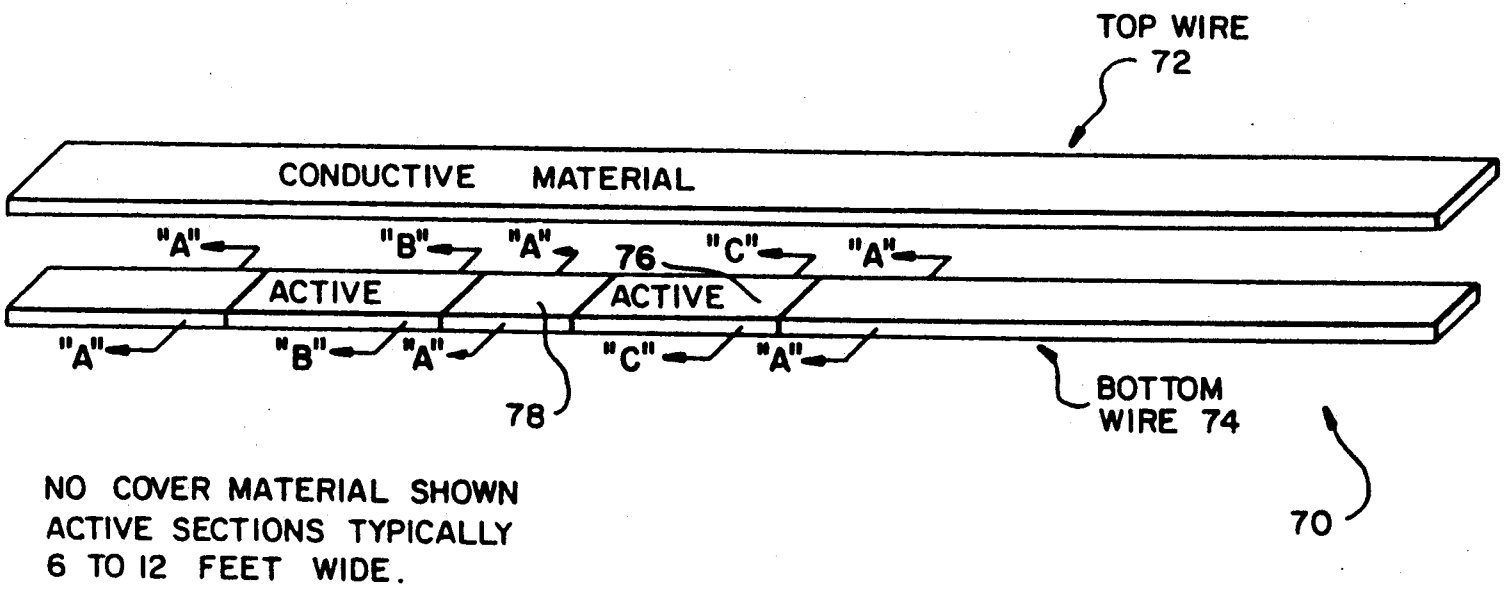
FIG. 11 illustrates an alternative cord construction.

As shown in FIG. 11, a cord 70 has upper portion 72 formed of a conductive material and lower portion 74. Lower portion 74 has a plurality of active sections 76 and passive sections 78. Typically, the active sections are between six and twelve feet wide, although they can be of any desired width and length. The upper and lower portions are normally spaced apart using a mechanism as discussed above. When a passing vehicle compresses cord 70, conductive upper portion 72 makes contact with lower portion 74. Compression of the upper and lower portions in the active areas result in a switch closure causing a counter to increment, while no switch closure results from compression of the cord in the passive areas.

Figure 12:
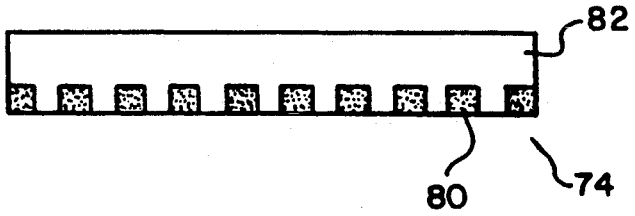
FIG. 12 illustrates a section of the alternative cord construction where switch actuation is not active.

FIG. 12 shows in cross section a passive section of the lower portion of the cord with typical dimensions. As FIG. 12 shows, the entirety of the lower portion of the cord has a plurality of individual conductive members 80 formed of resilient conductive material channeled through it. Ten such conductive members are shown in FIG. 12. Above and between the individual conductive members 80 is non-conductive material 82. The presence of this non-conductive material separates the conductive members 80 and prevents switch closure from occurring over the passive section when a passing vehicle compresses the conductive upper portion 72 into contact with the lower portion 74.

Figure 13A:
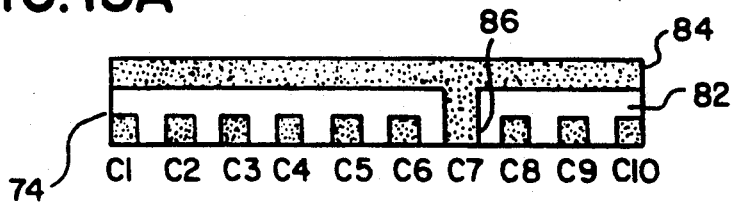
FIGS. 13*a* and 13*b* illustrate different sections in the alternative cord construction where switch actuation is active.
Figure 13B:
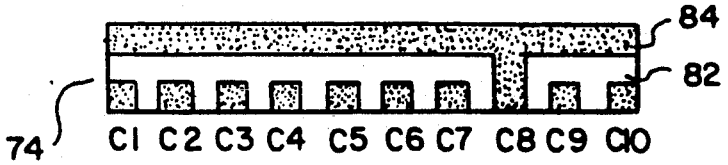

FIGS. 13a and 13b illustrate how contact is made to effect switch closure in the active sections to increment corresponding traffic counters connected to the members. In FIG. 13a, traffic is counted to increment traffic lane counter C7, while in FIG. 13b, traffic is counted in a lane corresponding to traffic counter C8. As FIGS. 13a and 13b illustrate, in the active section, lower portion 74 also has conductive members channeled through it. These are connected or continuous with corresponding conductive members in the passive sections. Non-conductive material 82 is used to separate the members 80 from each other and from a conductive layer 84 located on top of the lower portion. The conductive layer 84 is connected to at least one of the conductive members 80 through a communicating conductor 86. When a passing vehicle passes over an active section corresponding to a traffic lane and compresses the upper and lower portions together, the counter for the corresponding lane is incremented as a result of the switch closure. This is accomplished by interconnecting the conductive members of the sections in the same way as previously described for other embodiments. Thus, in FIG. 13a counter C7 is incremented by traffic passing over the corresponding lane. Traffic passing over lane 8 would not result in counter C7 being incremented. Instead, as shown in FIG. 13b, a counter C8 corresponding to traffic lane 8 would be incremented. The pattern can be repeated for each individual conductive member in the lower portion.

A further enhancement is possible if a cord is constructed using an upper portion having a construction similar to that of a lower portion. This allows the introduction of additional active sections. For instance, a first of the conductive members of the upper portion could establish contact with corresponding lower portion conductive members to count traffic in separate lanes. In a ten member lower portion, ten traffic lanes could be counted. Similarly, a second conductive member of the upper portion could be arranged to establish contact with corresponding lower portion conductive members to count traffic in another ten lanes. This could be repeated for any number of upper portion conductors.

Figure 14A:
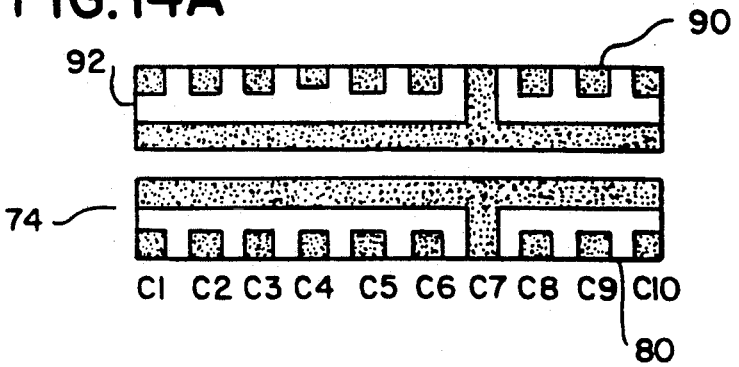
FIGS. 14*a*–14*d* illustrate a configuration which provides additional traffic lane counting ability.
Figure 14B:
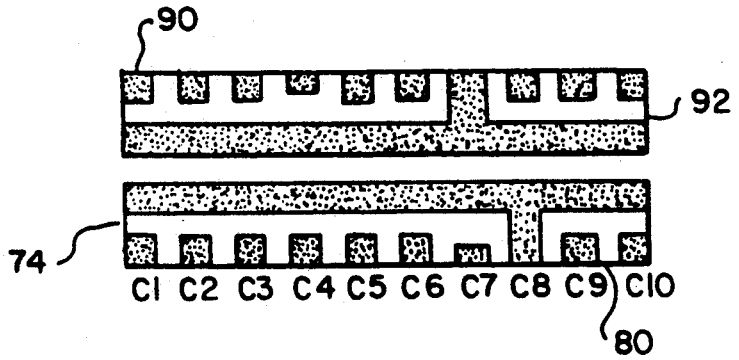
Figure 14C:
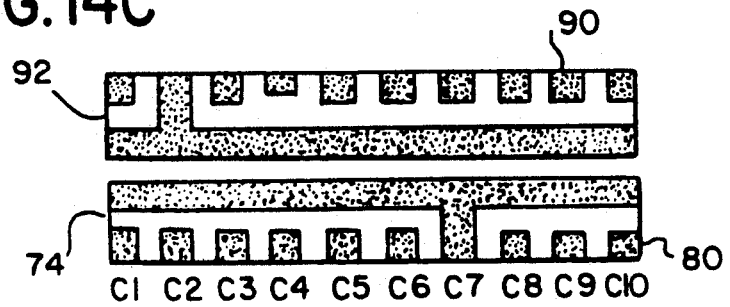
Figure 14D:
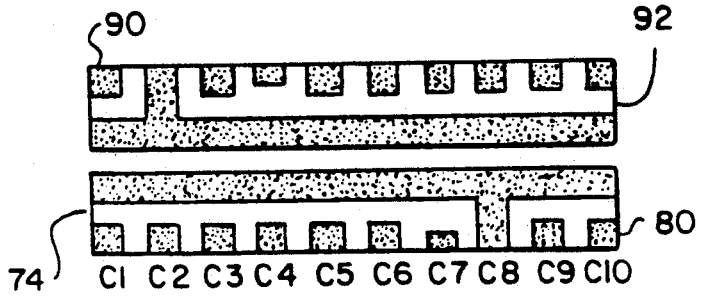
Figures 15A, 15B, 15C, 15D, 15E, 15F:
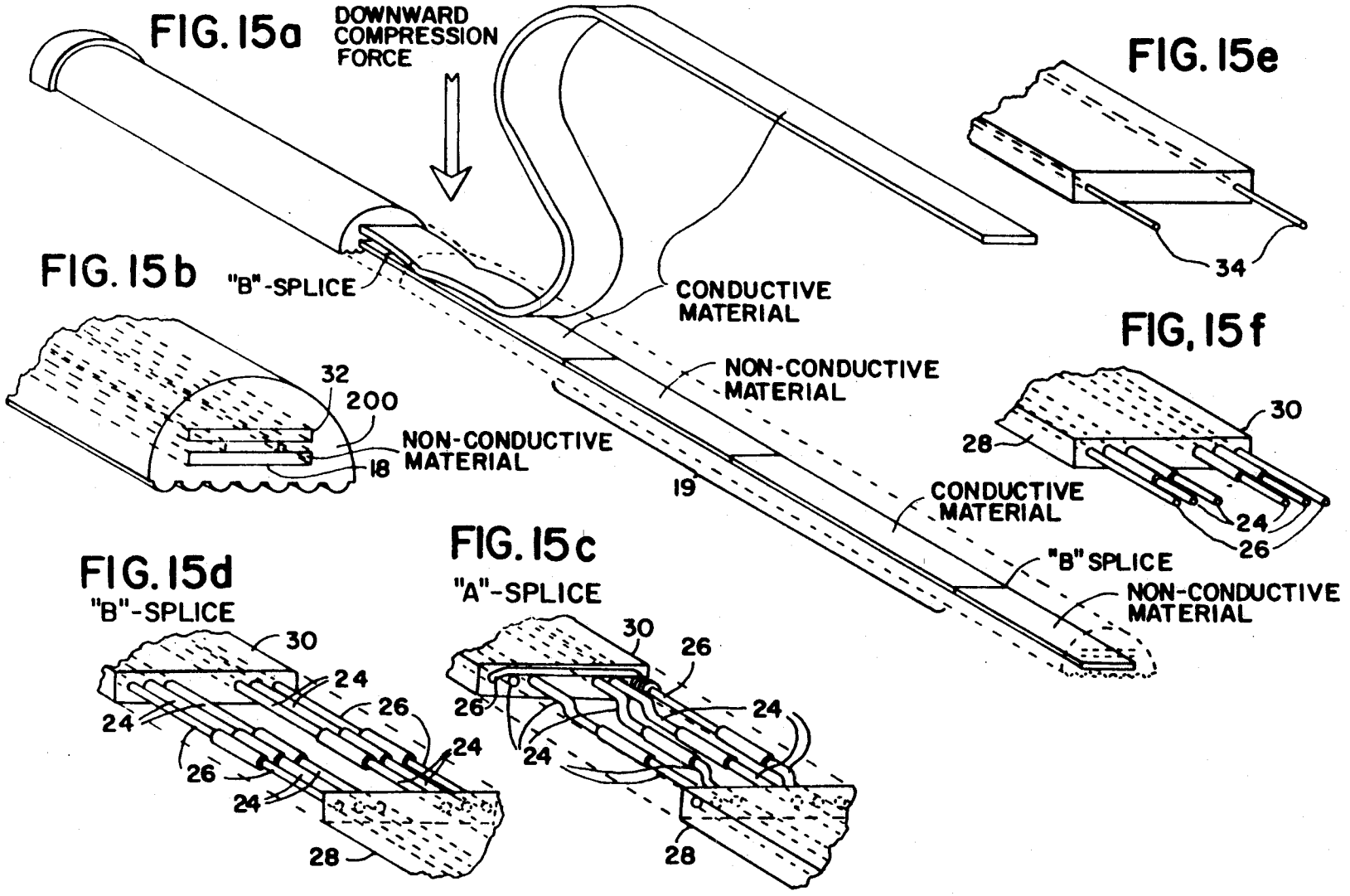
FIG. 15*a* shows an overall perspective cutaway illustrating the entire traffic cord of the invention.
FIG. 15*b* is an exploded view of an end perspective.
FIG. 15*c* is an exploded view of an "A" splice.
FIG. 15*d* is an exploded view of a "B" splice.
FIG. 15*e* is an exploded end view of a top wire.
FIG. 15*f* is an exploded end view of a bottom wires.

FIGS. 14*a*–14*d* illustrate this principle for two of the possible upper portion and lower portion configurations. FIGS. 14*a*–14*d* show upper portion 92 constructed in the same manner as lower portion 74 and separated from lower portion 4 so that contact between the upper and lower portions occurs only when the cord 70 is compressed. In FIGS. 14*a* and 14*b* the seventh of the conductive member 90 in the upper portion 92 is used to make contact with the members 80 in lower portion 74 corresponding to traffic lane counters C7 and C8, respectively. As discussed above, any of the members 80 in lower portion may be used, depending on which counter is to be activated. FIGS. 14*c* and 14*d* illustrate the second of the conductive members 90 in upper portion 92 used to make contact with the members 80 in lower portion 74 corresponding to traffic lane counters C7 and C8, respectively. It will be clear from the foregoing that any convenient combination of conductive members in the upper and lower portions can be arranged based on the number of conductive members available and that there is no theoretical limit to the number of conductive members used.

Figure 4A:
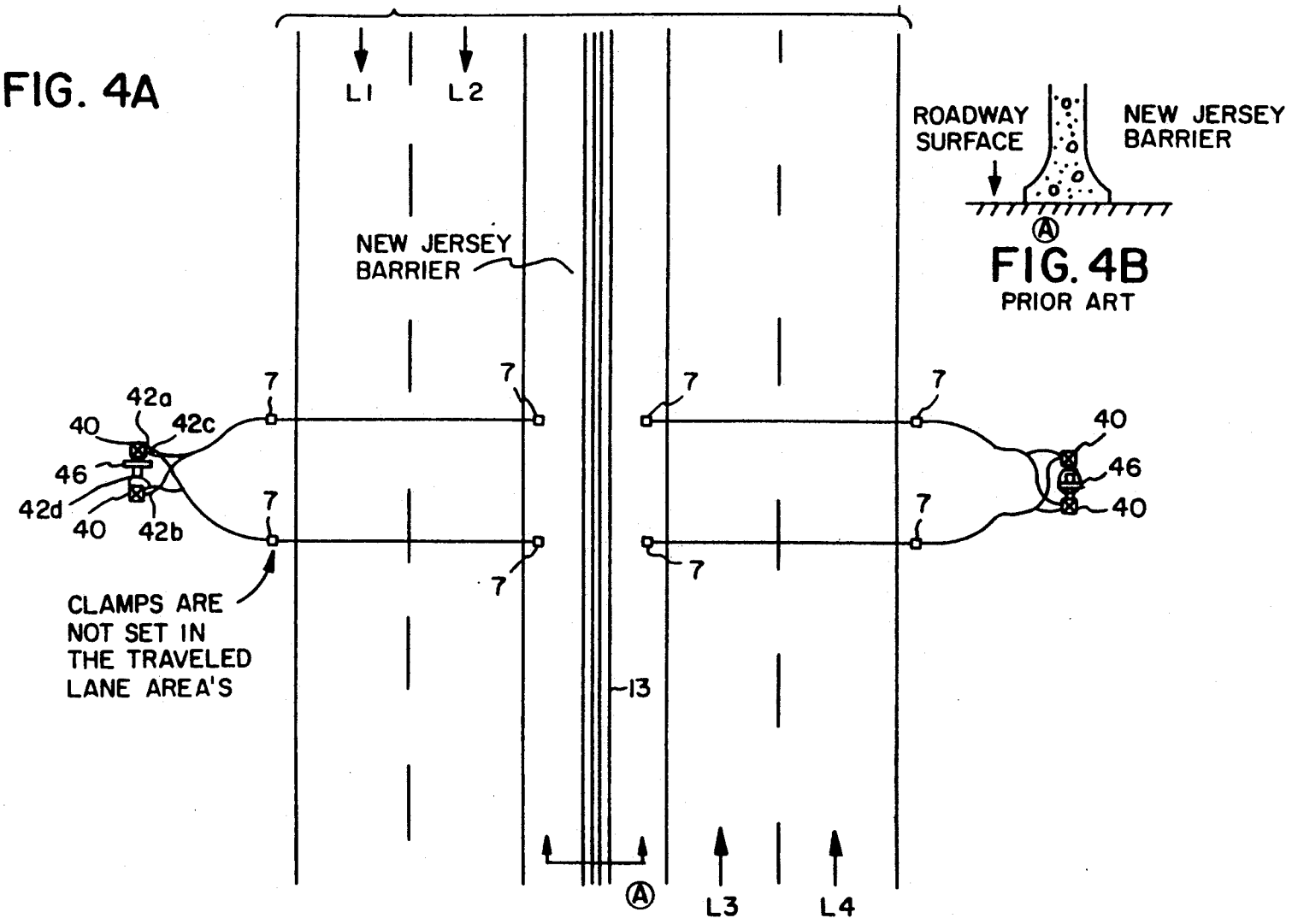
FIG. 4 illustrates a set up arrangement in accordance with the present invention.
Figure 5:
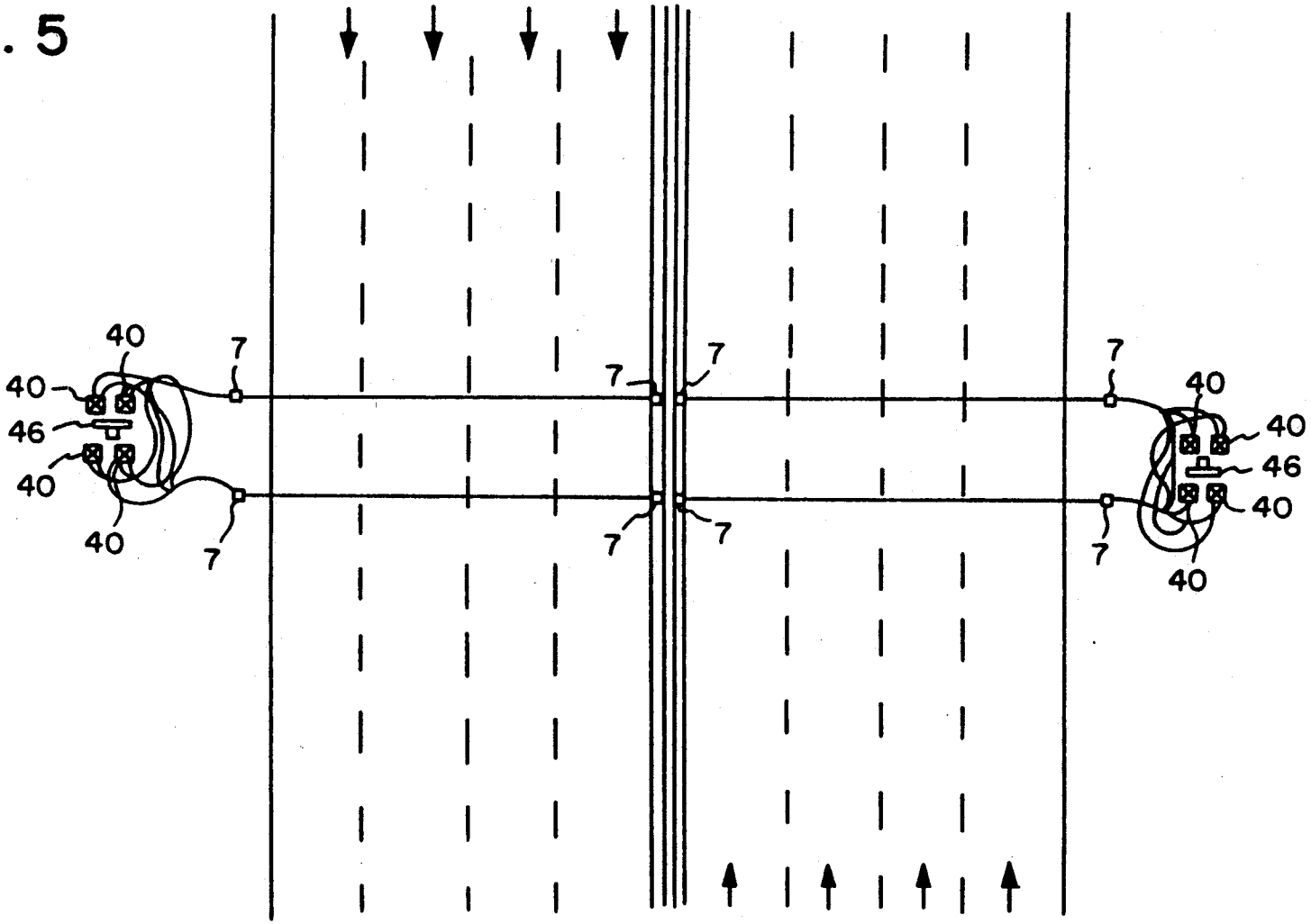
FIG. 5 illustrates an alternative set up arrangement in accordance with the present invention.

FIGS. 4 and 5 illustrate practical traffic counting configurations using the traffic counting cord described above. FIG. 4 shows a four lane configuration (2 lanes in each direction) where a New Jersey Barrier 13 exists in the road while FIG. 5 shows an eight lane configuration (4 lanes in each direction) without the New Jersey Barrier. Securing clamps 7 are located outside the traveled traffic lanes to hold counting cords 50 in position. The advantage is t is not necessary to employ a separate pneumatic tube and tied off for each lane as is the current practice. In FIGS. 4 and 5, the sections are cross spliced as discussed above and a separate wire from each cord for each lane is routed to a counter 40. For example, in FIG. 4, lane L1 has wires 42*a* and 42*b* routed to separate counters 40. As a result, it is possible to count lane L1 traffic data separately. As previously discussed, data concerning vehicle size, etc. can be derived from the time measured between counts from wires 42*a* and 42*b*. A similar approach applied to lane L2 using counter using wires 42*c* and 42*d*, can be extended to all the lanes shown in FIGS. 4 and 5. It should be noted that there is no limit to the number of lanes that can be counted in this way, as the size of the cord and the number of counters can be expanded accordingly. In addition, the plurality of counters 40 shown in FIGS. 4 and 5 is illustrative only, as several counters can be incorporated into a single counting machine. Counters are secured to a stationary member 46, such as a light pole or sign post.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A traffic counting cord comprising:

a plurality of sections, a pair of conductive members in each section, a plurality of insulated conductors in each section, selected ones of the insulated conductors in the sections being at least partially exposed and making electrical contact with both members of the pair of conductive members in a section under compression by traffic to be counted.

2. The traffic counting cord recited in claim wherein an upper one of the conductive members of the pair is disposed vertically above a lower one of the pair of conductive members.

3. The traffic counting cord recited in claim 2 wherein a conductor is embedded in a first of the conductive members and is exposed to make a common electrical contact with each of the sections and a reference voltage.

4. The traffic counting cord recited in claim 3 wherein a plurality of conductors is embedded in a second of the conductive members of the pair in each section, and in the sections different ones of the plurality of said conductors are exposed to make electrical contact with the common electrical contact in the first of the conductive members when the counting cord is compressed.

5. The traffic counting cord recited in claim 3 wherein a plurality of conductors is embedded in a second of the conductive members of the pair in each section, and in the sections outermost conductors of the plurality are exposed within the conductive member of the section to make electrical contact with the common electrical contact in the first of the conductive members when the counting cord is compressed.

6. The traffic counting cord recited in claim 5, wherein the outermost conductors of each section are spliced to insulated conductors of other sections, the insulated conductors being routed to counters, such that compressions of the counting cord in each of the plurality of sections are counted by a different counter, the counter corresponding to the section.

7. The traffic cord recited in claim 2 further comprising an insulating member disposed between portions o the conductive members, the insulating member separating the conductive members in each section when the section is not compressed.

8. The traffic cord recited in claim 7 wherein the insulating member is resilient.

9. The traffic cord recited in claim 1 wherein the conductive members are resilient.

10. The traffic counting cord recited in claim 1 wherein the insulated conductors comprise wires embedded in the conductive members.

11. The traffic counting cord recited in claim 1 wherein each of the at least partially exposed conductors corresponds to a lane of traffic to be counted.

12. The traffic cord recited in claim 1 wherein each section corresponds to a traffic lane to be counted.

13. The traffic cord recited in claim 1 wherein a single insulated conductor in each section is at least partially exposed.

14. The traffic cord recited in claim 1 wherein at least one of the selected ones of the conductors in each section is a different conductor from the selected ones of the conductors in the other sections.

15. The traffic cord recited in claim 1 wherein each section further comprises a portion having a pair of non-conductive members longitudinally adjacent each of the conductive members.

16. The traffic cord recited in claim 15 wherein the sections are assembled with alternating conductive and non-conductive portions, each lane of traffic to be counted having one conductive and one non-conductive portion.

17. The traffic cord recited in claim 16 wherein conductors from each of the adjacent portions are spliced together.

18. A traffic counting cord section comprising:

first and second resilient conductive members forming a pair, vertically disposed one over the other, a resilient insulating member disposed between portions of the conductive members, the insulating member separating the conducting members when the cord section is uncompressed and allowing electrical contact between the conductive members when the cord is compressed;

at least one conductor embedded within the first conductive member, at least a part of said at least one conductor making electrical contact with both conductive members of the pair under compression of the cord, the second conductive member being connected to a reference voltage.

19. A traffic cord section as recited in claim 18, further comprising a plurality of insulated conductors embedded in the first conductive member, insulation around the conductors preventing electrical contact between selected conductors and the conductive members of the section.

20. The traffic cord section recited in claim 19 wherein the first conductive member has a plurality of holes for embedding the insulated conductors, the holes being dimensioned to constrain the insulated conductors and allow the insulated conductors to move within the holes when force is applied between the insulated conductors and the conductive members.

21. The traffic cord section recited in claim 20 wherein the insulation around the conductors comprises nylon.

22. The traffic cord section recited in claim 19 further comprising at least one non-insulated conductor located at an outermost portion within the section.

* * * * *